US008991612B2

(12) United States Patent
Diez et al.

(10) Patent No.: US 8,991,612 B2
(45) Date of Patent: Mar. 31, 2015

(54) METHOD FOR OBTAINING NON-MAGNETIC ORES FROM A SUSPENSION CONTAINING ORE PARTICLE-MAGNETIC PARTICLE AGGLOMERATES

(75) Inventors: Michael Diez, Erlangen (DE); Argun Gökpekin, Hammelburg (DE); Wolfgang Krieglstein, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/128,758

(22) PCT Filed: May 31, 2012

(86) PCT No.: PCT/EP2012/060276

§ 371 (c)(1),
(2), (4) Date: Dec. 23, 2013

(87) PCT Pub. No.: WO2012/175308

PCT Pub. Date: Dec. 27, 2012

(65) Prior Publication Data

US 2014/0124415 A1 May 8, 2014

(30) Foreign Application Priority Data

Jun. 21, 2011 (EP) ..... 11170778

(51) Int. Cl.
*B03C 1/00* (2006.01)
*B03C 1/005* (2006.01)
*B03C 1/015* (2006.01)

(52) U.S. Cl.
CPC ..... *B03C 1/005* (2013.01); *B03C 1/015* (2013.01)
USPC ..... 209/232; 209/3; 209/5; 209/8; 209/39; 209/45; 209/66; 209/214; 209/215; 209/12.1; 210/222

(58) Field of Classification Search
None
See application file for complete search history.

(56) References Cited

U.S. PATENT DOCUMENTS 4,643,822 A 2/1987 Parsonage
6,139,736 A * 10/2000 Inaba ..... 210/222

(Continued)

FOREIGN PATENT DOCUMENTS

EP 2090367 8/2009
EP 11170778 6/2011

(Continued)

OTHER PUBLICATIONS

English Language International Search Report for PCT/EP2012/060276, mailed Jul. 10, 2012, 3 pages.

(Continued)

*Primary Examiner* — Prasad Gokhale
(74) *Attorney, Agent, or Firm* — Staas & Halsey LLP

(57) ABSTRACT

A method obtains non-magnetic ores from a suspension containing ore particle-magnetic particle agglomerates. The method involves dividing ore particle-magnetic particle agglomerates precipitated from the suspension into a mixture of separately present ore particles and magnet particles, separating the magnetic particles from the mixture, forming a first mass flow containing magnetic particles and a second mass flow containing ore particles. At least one information describing a measure of the content of ore particles in the first mass flow and being associated with the first mass flow and/or at least one information describing a measure of the portion of magnetic particles in the second mass flow and being associated with the second mass flow are determined in order to determine the efficiency of at least one of the separation processes described above.

14 Claims, 1 Drawing Sheet

(56) References Cited

U.S. PATENT DOCUMENTS

| | | | | |
|---|---|---|---|---|
| 8,342,336 | B2 * | 1/2013 | Diez et al. | 209/8 |
| 8,584,862 | B2 * | 11/2013 | Danov et al. | 209/8 |
| 2011/0163039 | A1 | 7/2011 | Danov et al. | |
| 2013/0015106 | A1 * | 1/2013 | Lins et al. | 209/214 |

FOREIGN PATENT DOCUMENTS

| | | |
|---|---|---|
| WO | 2009/101070 | 8/2009 |
| WO | 2010/031714 | 3/2010 |
| WO | PCT/EP2012/060276 | 5/2012 |

OTHER PUBLICATIONS

European Office Action for European Priority Patent Application No. 11170778.2, issued Nov. 24, 2011, 9 pages.

* cited by examiner

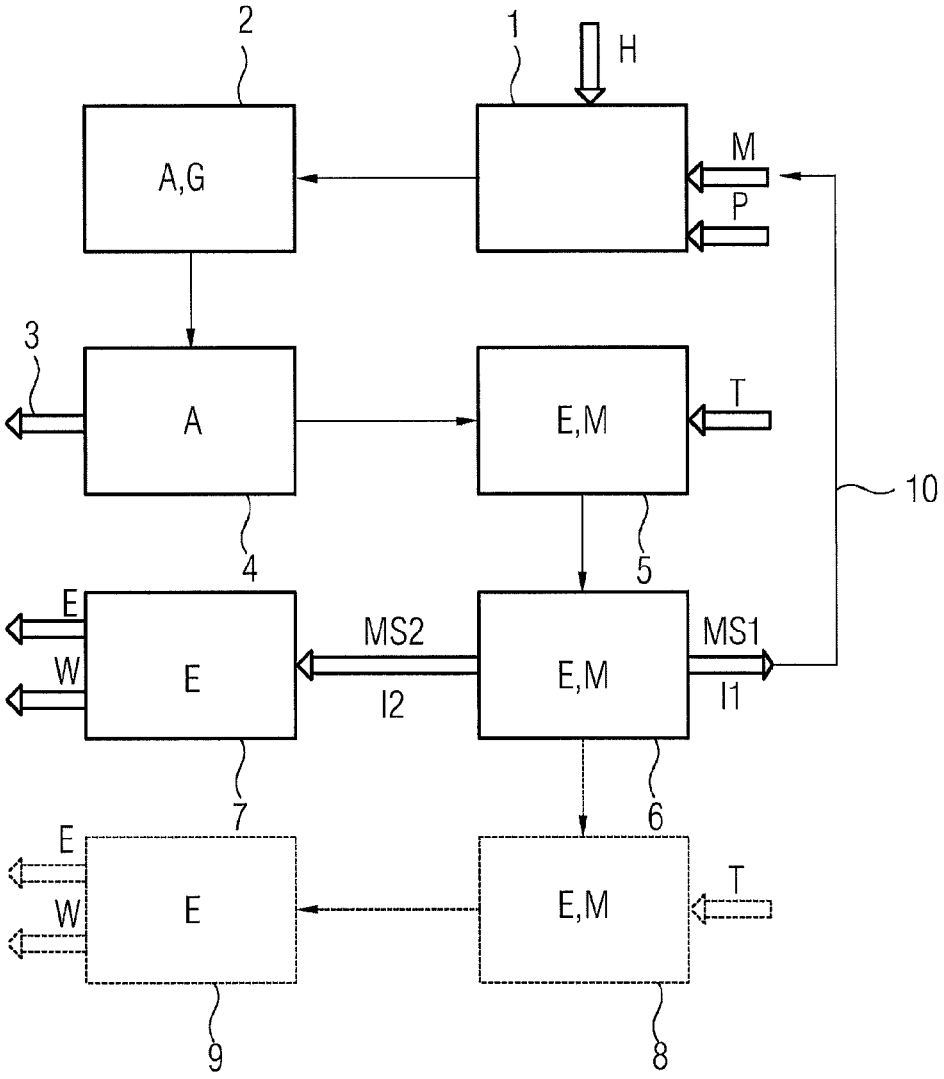
2
1
H
A,G
M
P
3
A
E,M
T
10
4
5
E
W
E
MS2
I2
E,M
MS1
I1
7
6
E
W
E
E,M
T
9
8

METHOD FOR OBTAINING NON-MAGNETIC ORES FROM A SUSPENSION CONTAINING ORE PARTICLE-MAGNETIC PARTICLE AGGLOMERATES

CROSS REFERENCE TO RELATED APPLICATIONS

This application is based on and hereby claims priority to International Application No. PCT/EP2012/060276 filed on May 31, 2012 and European Application No. 11170778.2 filed on Jun. 21, 2011, the contents of which are hereby incorporated by reference.

BACKGROUND

The invention relates to a method for obtaining non-magnetic ores from a suspension containing ore particle-magnetic particle agglomerates.

The use of flotation cells for obtaining ores from ore-containing bulk material is well known. An ore-containing pulp, i.e. essentially a suspension of water, ground rock (gangue) and ground ore is fed to a flotation cell or a flotation reactor.

In the context of "magnetic flotation" methods, the pulp is loaded (in a "load process") with magnetic particles, including, for example, magnetic particles in the form of magnetite, to form ore particle-magnetic particle agglomerates. In order to form the ore particle-magnetic particle agglomerates, prior hydrophobization both of the ore particles and of the magnetic particles is usually required. The formation of the ore particle-magnetic particle agglomerates thus produced essentially by hydrophobic interactions or by attractive forces is achieved by mixing the starting materials, taking account of particular mixing parameters such as shear forces, time, temperature, etc.

Separation of the ore particle-magnetic particle agglomerates from the pulp is carried out by a (first) separating device typically in the form of, or including, a magnetic separator, wherein the magnetic ore particle-magnetic particle agglomerates are extracted from the pulp and are transferred to a concentrate stream which essentially contains the ore particle-magnetic particle agglomerates, small quantities of gangue material and water.

Subsequently, the ore particle-magnetic particle agglomerates are split into the component parts thereof, specifically ore particles and magnetic particles, so that said materials are present together but unbound, in the form of a mixture (in an "unload process"). Typically, the separation of the ore particle-magnetic particle agglomerates is carried out by a further or second separating device with chemical processes with the use of suitable chemicals such as solvents or the like.

The subsequent separation of the magnetic particles which are present essentially in isolation, from the ore particles and the other components of the concentrate stream is also carried out in the context of the "unload" process using a further, or third, separating device, again typically in the form of, or comprising, a magnetic separator in which the magnetic particles are magnetically separated out. Thereafter, separation takes place into a first mass flow containing magnetic particles and a second mass flow containing ore particles, which are present separately from one another and essentially or ideally contain only the respective pure material, that is, either pure magnetic particles or pure ore particles.

A method of this type is disclosed by EP 2 090 367 A1, which relates to a method for the continuous recovery of non-magnetic ores from a pulp containing non-magnetic ore particles. In said process, magnetic or magnetizable magnetic particles are fed to a pulp continuously flowing through a reactor, said magnetic particles forming ore particle-magnetic particle agglomerates with the non-magnetic ore particles. The ore particle-magnetic particle agglomerates are moved by a magnetic field into an accumulator region of the reactor and are conducted out of the accumulator region of the reactor.

In the known methods, it is often problematic that the first mass flow containing magnetic particles still contains a certain content of ore particles and the second mass flow containing ore particles still contains a certain content of magnetic particles. Therefore, certain losses occur in relation both to the magnetic particles and the ore particles, because both the ore particles present in the first mass flow and the magnetic particles present in the second mass flow are not available, or only with significant effort, for further processing, negatively affecting the process yield. Detection of the composition of the first or second mass flow does not take place.

SUMMARY

It is therefore one potential object provide an improved method for obtaining non-magnetic ores, particularly with regard to monitoring the process yield of the "unload" process.

The inventors propose a method for obtaining non-magnetic ores from a suspension containing ore particle-magnetic particle agglomerates, comprising the steps:

dividing ore particle-magnetic particle agglomerates precipitated from the suspension into a mixture of ore particles and magnetic particles which are present together but separately, separating out the magnetic particles from the mixture, forming a first mass flow containing magnetic particles and a second mass flow containing ore particles, which is characterized in that, in order to determine the efficiency of at least one of the separation processes described above, at least one item of information associated with the first mass flow and giving a measure of the content of ore particles in the first mass flow and/or at least one item of information associated with the second mass flow and giving a measure of the content of magnetic particles in the second mass flow is determined.

The method provides for investigating the first and/or second mass flow, i.e. the first mass flow containing magnetic particles and/or the second mass flow containing ore particles, directly or indirectly, qualitatively or quantitatively with regard to the composition thereof. This is carried out by a determination of the at least one item of information associated with the first mass flow and giving a measure of the content of ore particles in the first mass flow and also or alternatively by a determination of the at least one item of information associated with the second mass flow and giving a measure of the content of magnetic particles in the second mass flow. Accordingly, the item of information associated with the first mass flow represents a measure of the content of ore particles in the first mass flow, which ideally contains only magnetic particles, and the item of information associated with the second mass flow represents a measure of the content of magnetic particles in the second mass flow, which, in an ideal case, contains only ore particles. Therefore, the relevant composition can be determined qualitatively or quantitatively and a degree of contamination or a degree of purity of the respective mass flow can be determined.

The degree of contamination relates qualitatively or quantitatively to the content of unwanted particles contained in the respective mass flow, whilst the degree of purity accordingly relates qualitatively or quantitatively to the content of desired particles contained in the respective mass flow.

The item of information associated with the first mass flow therefore provides an indication of the efficiency of a, or the, aforementioned separating device which separates the magnetic particles out of the mixture of ore particles and magnetic particles which are present together but separately. The item of information associated with the second mass flow therefore provides, in particular, an indication of the efficiency of a, or the, aforementioned separating device which separates the ore particle-magnetic particle agglomerates into a mixture of ore particles and magnetic particles which are present together but separately.

The respective items of information can also provide a measure of the respective proportional contents of magnetic and ore particles so that from the ratio of unwanted particles to desired particles or vice versa, conclusions can be drawn concerning the purity or contamination of the respective mass flow.

In contrast to the methods known from the related art, the "unload" process, in particular, can therefore be monitored with regard to the efficiency or yield thereof, so that naturally conclusions concerning the efficiency or yield of the overall process can also be obtained indirectly.

In the context of the method, it is not essential always to determine both items of information. It can therefore be sufficient if just the first item of information associated with the first mass flow is determined. Naturally, the determination of both the items of information associated with the first and the second mass flow provides a more informative picture of the efficiency or yield of the "unload" process and thus, indirectly also, of the efficiency or yield of the overall process.

The determination of the items of information associated with the first and/or the second mass flow is preferably carried out by X-ray fluorescence spectrometry. Naturally, other suitable methods for determining the relevant item(s) of information are also conceivable.

Magnetic particles are to be understood as being all magnetic or magnetizable particles. Ferromagnetic particles such as magnetite ($Fe_3O_4$) are mentioned purely by way of example.

Ore particles should be understood to be all non-magnetic, i.e. neither initially or in relation to the magnetic particles only weakly magnetic nor magnetizable or in relation to the magnetic particles, only weakly magnetizable, ore particles. Copper ores such as chalcocite ($Cu_2S$) are mentioned purely by way of example.

The division of the ore particle-magnetic particle agglomerates precipitated from the suspension into the mixture of ore particles and magnetic particles which are present together but separately, carried out in the proposed method, and the separation of the magnetic particles out of the mixture takes place via suitable separating devices.

The separation of the ore particle-magnetic particle agglomerates precipitated from the suspension containing ore particle-magnetic particle agglomerates provided in the context of the method into the mixture of ore particles and magnetic particles which are present together but separately, can precede forming ore particle-magnetic particle agglomerates from a suspension containing ore particles and magnetic particles, said ore particle-magnetic particle agglomerates comprising at least one ore particle and at least one magnetic particle, and also thereafter a subsequent precipitating the ore particle-magnetic particle agglomerates out of the suspension by a suitable separating device.

Therefore, the separating device for precipitating the ore particle-magnetic particle agglomerates out of the suspension can be designated the first separating device, the separating device for separating the ore particle-magnetic particle agglomerates precipitated from the suspension into the mixture of ore particles and magnetic particles which are present together but separately can be designated the second separating device, and the separating device for separating the magnetic particles out of the mixture can be designated the third separating device.

All the separating devices can have one or more separating areas, separating chambers, separating arrangements or the like associated therewith.

In a suitable development, it is provided that, based on the item of information associated with the first and/or second mass flow, at least one item of operating information required for the operation of at least one separating device for separating the ore particle-magnetic particle agglomerates into a mixture of ore particles and magnetic particles which are present together but separately and/or at least one separating device for separating the magnetic particles from the mixture of ore particles and magnetic particles which are present together but separately, is set and/or adjusted. Therefore, the item of information associated with the first and/or second mass flow is not used only as an indication of the degree of purity or the degree of contamination of the mass flows or of the process yield, in particular, of the "unload" process, but serves equally as a control signal for setting or adjusting at least one item of operating information required for the operation of at least one separating device for separating the ore particle-magnetic particle agglomerates into a mixture of ore particles and magnetic particles which are present together but separately and/or for separating out the magnetic particles from the mixture of ore particles and magnetic particles which are present together but separately. As a consequence, the relevant operating information can be adjusted or optimized depending on the relevant item of information associated with the first and/or second mass flow, so that the efficiency of the relevant separating device can be optimized depending on the actual operating conditions represented by the item(s) of information associated with the first and/or second mass flow(s) and the yield, in particular, of the "unload" process can be increased.

It is advantageous if the items of information associated with the first and/or second mass flow is/are compared with a threshold value giving a minimum or maximum concentration of ore particles or magnetic particles, wherein the setting and/or adjustment of the operating information is carried out taking account of the threshold value. By setting a threshold value, which expression should also be understood to cover corresponding threshold value ranges, particularly simple and rapid quality monitoring of, in particular, the "unload" process can take place and then settings and/or adjustments of the at least one item of operating information concerning the relevant separating device(s) for the purpose of process optimization can be carried out.

If, for example, the exceeding of a threshold value, which naturally can also include corresponding tolerance ranges is detected in the first mass flow containing magnetic particles by the item of information associated therewith, i.e. the content of ore particles in the first mass flow is increased above a pre-defined or pre-definable norm value, a corresponding adjustment is made, in particular, of at least one item of operating information relating to the separating device separating the ore particle-magnetic particle agglomerates into a mixture of ore particles and magnetic particles which are present together but separately.

The same applies, naturally, for the exceeding of a corresponding threshold value in the second mass flow containing ore particles, which is detected via the item of information associated with said mass flow. This means that, in this case, the content of magnetic particles in the second mass flow is increased above a pre-defined or pre-definable norm value, whereupon a corresponding adjustment is made, in particular, of at least one item of operating information relating to the separating device separating the magnetic particles out of the mixture of ore particles and magnetic particles which are present together but separately.

Naturally, for the setting of threshold values, corresponding lower limits can also be provided which, in relation to the content of magnetic particles in the first mass flow or in relation to the content of ore particles in the second mass flow, must not be undershot. In this case, therefore, on undershooting the threshold values, a corresponding change and/or setting of the operating information of the relevant separating device(s) takes place.

All the procedures are determined, detected and, in particular, evaluated with suitable evaluating algorithms via a plurality of decentralized control devices which communicate with one another or via one centralized control device, and optionally stored in a storage medium.

It can be suitable if initially only one item of operating information relating to the separating device for separating the ore particle-magnetic particle agglomerates into a mixture of ore particles and magnetic particles which are present together but separately is set and/or adjusted and, following the adjustment of the relevant at least one item of operating information, renewed determination of the item of information associated with the first and/or second mass flow is carried out. This procedure is suitable to the extent that the setting and/or adjustment of the operating information relating to the separating device separating the ore particle-magnetic particle agglomerates into a mixture of ore particles and magnetic particles which are present together but separately ensures a fundamentally optimized separation of the ore particle-magnetic particle agglomerates into separately present constituents which later exert a significant influence on the yield of the further separating device separating the magnetic particles out of the mixture of ore particles and magnetic particles which are present together but separately.

Therefore, in the context of the method, in the first place, setting and/or adjustment of at least one item of operating information relating to the separating device separating the ore particle-magnetic particle agglomerates into a mixture of ore particles and magnetic particles which are present together but separately takes place before an additional setting and/or adjustment of at least one item of operating information relating to the, or a, separating device separating the magnetic particles from the mixture of ore particles and magnetic particles which are present together but separately, is carried out.

It should again be mentioned at this point that it is equally possible simply to carry out the setting and/or adjustment of at least one item of operating information relating to the, or a, separating device separating the magnetic particles out of the mixture of ore particles and magnetic particles which are present together but separately.

It is conceivable that before the actual setting and/or adjustment of the at least one item of operating information, an expected associated adjustment of the first and/or second item of information associated with the first and/or second mass flow is simulated. A simulation, which typically takes place using suitable simulation algorithms, therefore enables a predictive evaluation of the effects associated with the setting and/or adjustment to be carried out on the at least one item of operating information with regard to the item of information associated with the first and/or second mass flow. It is also possibly conceivable to store in a storage medium settings and/or adjustments made earlier in time on the respective operating parameters with regard to the associated effects on the first and/or second mass flow and to take account thereof in the context of the simulation. In this way, an extensively automated optimization of the content of unwanted particles in the respective mass flows can be realized.

In the following description, suitable items of operating information for the various separating devices are given by way of example. The list is not definitive.

As the operating information for the separating device for separating the ore particle-magnetic particle agglomerates into a mixture of ore particles and magnetic particles which are present together but separately, for example, the concentration and/or the composition of a separating agent separating the ore particle-magnetic particle agglomerates into the constituents thereof and/or a shear rate of the second separating device and/or the dwell time of the ore particle-magnetic particle agglomerates in the second separating device and/or the composition of the suspension, in particular, a water content of the suspension, is used.

As the operating information for the separating device for separating the magnetic particles out of the mixture of ore particles and magnetic particles which are present together but separately, for example, at least one magnetic parameter, in particular, the field strength and/or a field gradient of the magnetic device and/or device for influencing the flow characteristics of the second mass flow, in particular in the form of apertures and/or displacing elements and/or the flow rate of the second mass flow and/or a flushing flow can be used. The setting of magnetic parameters is effective, in particular, where a moving magnetic field separator is used as a magnetic device associated with the respective separating device. This includes the setting of suitable signal exciter forms, signal frequencies, signal phase positions of relative signal forms, such as anti-phase, in-phase, speed relative to the flow of the suspension or pulp and other magnetic parameters affecting the magnetic field.

The determination of the items of information associated with the first and/or the second mass flow can be carried out continuously or discontinuously. In the case of a continuous determination of the item of information associated with the first and/or second mass flow, an item of information associated with the first and/or second mass flow is continuously determined at all times, so that a complete depiction of the process management with respect to the yield, particularly of the "unload" process, is obtained.

In the event of discontinuous determination of the items of information associated with the first and/or the second mass flow, determination of the items of information associated with the first and/or second mass flow is carried out at predefined or pre-definable time points, for example, once per minute. Both variations enable an "in situ" or "online" determination of the items of information associated with the first and/or the second mass flow. However, sample taking from the first and/or second mass flow is also to be understood as a discontinuous determination of the item of information associated with the first and/or second mass flow, said sample being tested separately from the method, for example, in a laboratory, to determine the composition thereof.

Continuous regulation of the method is preferably carried out by the continuous determination of the items of information associated with the first and/or the second mass flow. Therefore, within the context of the method, a measure of the content of ore particles in the first mass flow containing magnetic particles, and/or a measure of the content of magnetic particles in the second mass flow, containing ore particles can be determined. The continuous determination of the relevant items of information associated with the first and/or second mass flow therefore enables continuous or dynamic regulation or optimization of the process, so that process management of changing process parameters, such as the ore composition, is rapidly adjusted, that is, even optionally in real time.

With regard to the separating device separating the ore particle-magnetic particle agglomerates into the constituent parts thereof, i.e. into a mixture of ore particles and magnetic particles which are present together but separately, it is possible for the ore particle-magnetic particle agglomerates fed to said separating device to be separated chemically, in particular by a change in the pH value and/or by the addition of chemical separating agents or solvents and/or physically, in particular by adjusting the temperature, and/or mechanically, in particular, with ultrasonic waves from an ultrasonic device associated with the relevant separating device. This list is given purely by way of example and is not in any sense complete, so that other similarly acting possibilities for separating the ore particle-magnetic particle agglomerates into the constituent parts thereof are also conceivable.

In addition to the method, the inventors propose a device for obtaining non-magnetic ores from a suspension containing ore particle-magnetic particle agglomerates. The device comprises at least one stirred-tank reactor for mixing a suspension containing non-magnetic ore particles and magnetic particles, forming ore particle-magnetic particle agglomerates, at least one first separating device comprising at least one magnetic device for separating the ore particle-magnetic particle agglomerates out of the suspension, and also comprises at least one second separating device for separating the ore particle-magnetic particle agglomerates into a mixture of ore particles and magnetic particles which are present together but separately, and at least one third separating device for separating the magnetic particles out of the mixture of ore particles and magnetic particles which are present together but separately, and at least one detecting device for determining at least one item of information giving a measure for the content of ore particles in a mass flow containing magnetic particles and/or for determining at least one item of information giving a measure for the content of magnetic particles in a mass flow containing ore particles, and at least one control and/or regulating device which comprises at least one machine-readable program configured to control and/or regulate the device for carrying out the above described method.

The inventors also propose a control and/or regulating device for controlling and/or regulating a device as described above for carrying out the method. The control and/or regulating device comprises at least one machine-readable program which comprises control and/or regulating commands for controlling and/or regulating the device for carrying out the method as described above.

The inventors further propose a machine-readable program for a control and/or regulating device as described above.

BRIEF DESCRIPTION OF THE DRAWINGS

These and other objects and advantages of the present invention will become more apparent and more readily appreciated from the following description of the preferred embodiments, taken in conjunction with the accompanying drawing of which:

FIG. 1 is a block circuit diagram of the proposed method for obtaining non-magnetic ores from a suspension containing ore particle-magnetic particle agglomerates.

DETAILED DESCRIPTION OF THE PREFERRED EMBODIMENT

Reference will now be made in detail to the preferred embodiments of the present invention, examples of which are illustrated in the accompanying drawing, wherein like reference numerals refer to like elements throughout.

FIG. 1 shows a block circuit diagram of one potential embodiment for the proposed method for obtaining non-magnetic ores from a suspension containing ore particle-magnetic particle agglomerates. The process is preferably a continuous process.

In box 1 magnetic particles M are added to a pulp P in a stirred-tank reactor associated with a device for obtaining non-magnetic ores from a suspension containing non-magnetic ore particles E and magnetic particles M, which device can be designated a magnetic flotation cell. The pulp P primarily includes non-magnetic ore particles E, for example Cu2S particles and the magnetic particles M are present, for example, in the form of magnetite (Fe3O4), and are optionally already hydrophobized. A process of mixing the substances added to the stirred-tank reactor is carried out while adding further additives, for example, particularly hydrophobizing agents H which enable hydrophobization of the ore particles E.

In box 2, the "load" process takes place, wherein the hydrophobized magnetic particles M become deposited on the hydrophobized ore particles E or interact therewith, forming ore particle-magnetic particle agglomerates A. The ore particle-magnetic particle agglomerates A thus obtained in the suspension comprise at least one hydrophobized magnetic particle M and at least one hydrophobized ore particle E. The magnetic particles M are to be regarded as carrier particles for the ore particles E.

Essential influencing factors for achieving an efficient yield of ore particle-magnetic particle agglomerates A are the mixing duration, the shear forces acting during the mixing process and possibly the degree of grinding, as well as the grain size or grain size distribution of the ore particles E contained in the pulp P.

In box 4, separation of the ore particle-magnetic particle agglomerates A from the gangue G takes place. The separation is carried out magnetically by a first separating device comprising magnetic devices. The ore particle-magnetic particle agglomerates A which are magnetic due to the magnetic particles M collect in the region of the magnetic device and can be removed and thus largely separated from the gangue G. Non-agglomerated magnetic particles M and ore particles E and other pulp P which is regarded as being a dispersed system are carried away as residues (tailings) (arrow 3).

In the subsequent box 5, the concentrated ore particle-magnetic particle agglomerates A are fed to a second separating device in which the ore particle-magnetic particle agglomerates A are separated (in an "unload" process) into a mixture of ore particles E and magnetic particles M which are present together but separately. The separation of the ore particle-magnetic particle agglomerates A can be carried out, for example, chemically, in particular, by changing the pH value and/or by adding chemical separating agents T. Also conceivable is the use of ultrasonic waves introduced with an ultrasonic device associated with the second separating device.

Altogether, what takes place herein is a mixing process which, by applying shear forces and chemical substances in the form of the separating agents T based on surfactants, brings about dehyrophobization of the magnetic particles M and the ore particles E, thus separating the ore particle-magnetic particle agglomerates A into the constituents thereof. It is possible that in the second separating device, a particular content of gangue G is present which was not able to be properly separated in the previous, box 4 process.

In the box identified as 6, the "unload" process is largely completed, i.e. a mixture of ore particles E and magnetic particles M which are present together but separately has been created. The magnetic particles M present in isolation are magnetically separated via a third separating device comprising a magnetic device, in particular a moving field magnetic separator, from the non-magnetic ore particles E and are transferred to a first mass flow MS1 containing magnetic particles M.

Evidently, the first mass flow MS1 can be fed back so that the magnetic particles M contained therein can be reused at the start of the process (arrow 10). Accordingly, the whole process can be optimized from the economic and ecological standpoints.

The ore particles E are transferred to a second mass flow MS2 which contains ore particles E and which, in the further process, is dehydrated and/or dried (box 7), so that after dehydration or drying, ore particles E which are as dry as possible are the result. The water W is conducted away separately.

Ideally, the first mass flow MS1 contains only magnetic particles M and the second mass flow MS2 contains only ore particles E. However, in practice, this is difficult to realize and therefore leads to a certain degree of loss of ore particles E bound into the first mass flow MS1 and of magnetic particles M bound into the second mass flow MS2.

The method is characterized in that the determination of at least one item of information I1 associated with the first mass flow MS1 and giving a measure of the content of ore particles E in the first mass flow MS1 and/or the determination of at least one item of information I2 associated with the second mass flow MS2 and giving a measure of the content of magnetic particles M in the second mass flow MS2 is carried out. Accordingly, the composition, the degree of purity or the degree of contamination of the respective mass flows MS1, MS2, which are equally a measure of the yield, in particular, of the "unload" process can be detected and then taken into account for the control of the continuously proceeding method.

The determination of the items of information I1, I2 associated with the first and/or the second mass flow MS1, MS2 is preferably carried out continuously using X-ray fluorescence spectrometry.

It is also possible that at least one item of operating information required for operation of the second and/or third separating device is set and/or adjusted, based on the items of information I1, I2 associated with the first and/or second mass flow MS1, MS2. Therefore, in view of the continuously detected degree of purity or the continuously detected composition of the mass flows MS1, MS2, a control signal is sent to the second and/or third separating device, wherein based on the control signal, relevant operating information or operating parameters can be optimized.

The items of information I1, I2 associated with the first and/or second mass flow MS1, MS2 can herein be compared with at least one threshold value giving a minimum or maximum concentration of ore particles E or magnetic particles M. Accordingly, the setting and/or adjustment of the operating information is carried out taking the threshold value into account. The threshold value can also be regarded as a threshold value range and can take account of certain tolerance ranges.

Overall, the method can be made dynamic since, depending on the items of information I1, I2 associated with the first and/or second mass flow MS1, MS2, it is always possible to adapt the relevant items of operating information or the operating parameters of the separating devices used in the method in an individual manner, according to need.

As the operating information for the second separating device, for example, the concentration and/or the composition of a separating agent T separating the ore particle-magnetic particle agglomerates A into the constituents thereof and/or a shear rate of the second separating device and/or the dwell time of the ore particle-magnetic particle agglomerates A in the second separating device and/or the composition of the pulp P, in particular, a water content of the pulp P, can be used.

As the operating information for the third separating device, for example, at least one magnetic parameter, in particular, the field strength and/or a field gradient of the magnetic device and/or device for influencing the flow characteristics of the second mass flow, in particular in the form of apertures and/or displacing elements and/or the flow rate of the second mass flow and/or a flushing flow can be used.

The boxes 8, 9 shown dashed indicate that, based on the knowledge obtained from the first and/or second items of information I1, I2 relating to the composition of the mass flows MS1, MS2, optionally a new mixing process (box 8) can be carried out in order to mix again residues, that is, ore particle-magnetic particle agglomerates A not separated or split following the separation carried out in box 6. Here, the addition of a more concentrated separating medium T may be suitable and this can be controlled depending on the first and/or second item of information I1, I2. Accordingly, a further dehydration or drying process is performed (box 9).

Particular embodiments of the method provide that initially only at least one item of operating information relating to the second separating device is set and/or adjusted and, following the change of the relevant at least one item of operating information, renewed determination of the item of information I1, I2 associated with the first and/or second mass flow MS1, MS2 is carried out.

It is also conceivable that before the actual setting and/or adjustment of the at least one item of operating information, an adjustment expected to be associated therewith of the first and/or second item of information I1, I2 related to the first and/or second mass flow MS1, MS2 is simulated.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV*, 69 USPQ2d 1865 (Fed. Cir. 2004).

The invention claimed is:

1. A method for obtaining non-magnetic ores from a suspension containing ore particle-magnetic particle agglomerates, comprising:

allowing the agglomerates to precipitate from the suspension;

performing a splitting process to split the agglomerates that precipitated from the suspension, the agglomerates being split to form a mixture of ore particles and magnetic particles which are present together but separately;

performing a separating process to separate the mixture to form a first mass flow containing magnetic particles together with ore particle impurities and a second mass flow containing ore particles together with magnetic particle impurities;

determining purity information, the purity information relating to at least one of a content of ore particle impurities in the first mass flow and/or a content of magnetic particle impurities in the second mass flow; and using the purity information to determine an efficiency of at least one of the splitting process and the separating process.

2. The method as claimed in claim 1, wherein the splitting process is performed in a splitting device, the separating process is performed in a separating device, and based on the purity information an operating parameter is set for at least one of the splitting device and/or the separating device.

3. The method as claimed in claim 2, wherein the purity information is compared with at least one impurity threshold value in a comparison, and the operating parameter is set based on the comparison.

4. The method as claimed in claim 2, wherein an initial setting is applied to the operating parameter and then the purity information is re-determined.

5. The method as claimed in claim 2, wherein before making an adjustment to the operating parameter, a simulation is performed to estimate how the purity information will respond to the adjustment.

6. The method as claimed in claim 2, wherein the splitting device uses a separating agent and shear forces to split the agglomerates, and the operating parameter is at least one parameter selected from the group consisting of a concentration of the separating agent, a composition of the separating agent, a shear rate in the splitting device, a dwell time in the splitting device and a water content of the suspension.

7. The method as claimed in claim 2, wherein the separating device uses a magnetic device, and the operating parameter is at least one parameter selected from the group consisting of a magnetic field strength of the magnetic device, a magnetic field gradient of the magnetic device, an aperture setting for the second mass flow, a displacing element setting for the second mass flow, a flow rate of the second mass flow and a flushing flow rate used for the second mass flow.

8. The method as claimed in claim 2, wherein the purity information is determined continuously to thereby continuously control the operating parameter.

9. The method as claimed in claim 1, wherein the purity information is determined with X-ray fluorescence spectrometry.

10. The method as claimed in claim 1, wherein the purity information is determined continuously.

11. The method as claimed in claim 1, wherein the purity information is determined discontinuously.

12. A system to obtain non-magnetic ores, comprising:

a stirred-tank reactor to mix magnetic particles with a suspension containing non-magnetic ore particles, to thereby form ore particle-magnetic particle agglomerates;

a first magnetic separating device to separate the ore particle-magnetic particle agglomerates out of the suspension;

a splitting device to split the ore particle-magnetic particle agglomerates, the agglomerates being split to form a mixture of ore particles and magnetic particles which are present together but separately;

a second magnetic separating device to separate the mixture and form a first mass flow containing magnetic particles together with ore particle impurities and a second mass flow containing ore particles together with magnetic particle impurities;

a detecting device to determine purity information, the purity information relating to at least one of a content of ore particle impurities in the first mass flow and/or a content of magnetic particle impurities in the second mass flow; and a control device to control at least one of the stirred-tank reactor, the first magnetic separating device, the splitting device, the second magnetic separating device and the detecting device.

13. The system as claimed in claim 12, wherein the control device comprises:

a processor; and at least one non-transitory computer readable medium storing a program, which when executed by the processor, causes the processor to control the stirred-tank reactor, the first magnetic separating device, the splitting device, the second magnetic separating device and the detecting device.

14. A non-transitory computer readable medium storing a program, which when executed by a processor, causes the processor to control a method for obtaining non-magnetic ores from a suspension containing ore particle-magnetic particle agglomerates, the method comprising:

allowing the agglomerates to precipitate from the suspension;

performing a splitting process to split the agglomerates that precipitated from the suspension, the agglomerates being split to form a mixture of ore particles and magnetic particles which are present together but separately;

performing a separating process to separate the mixture to form a first mass flow containing magnetic particles together with ore particle impurities and a second mass flow containing ore particles together with magnetic particle impurities;

determining purity information, the purity information relating to at least one of a content of ore particle impurities in the first mass flow and/or a content of magnetic particle impurities in the second mass flow; and using the purity information to determine an efficiency of at least one of the splitting process and the separating process.

* * * * *

UNITED STATES PATENT AND TRADEMARK OFFICE

CERTIFICATE OF CORRECTION

PATENT NO. : 8,991,612 B2
APPLICATION NO. : 14/128758
DATED : March 31, 2015
INVENTOR(S) : Michael Diez et al.

It is certified that error appears in the above-identified patent and that said Letters Patent is hereby corrected as shown below:

In the Claims

Column 11, Line 8, In claim 1, delete “and/or” and insert -- and --, therefor.
Column 11, Line 19, In claim 2, delete “and/or” and insert -- and --, therefor.
Column 12, Line 19, In claim 12, delete “and/or” and insert -- and --, therefor.
Column 12, Line 53, In claim 14, delete “and/or” and insert -- and --, therefor.

Signed and Sealed this
Twenty-third Day of June, 2015

Michelle K. Lee

Michelle K. Lee
*Director of the United States Patent and Trademark Office*